United States Patent [19]

Prosser

[11] 4,190,930

[45] Mar. 4, 1980

[54] WINDOW AND SASH BALANCE

[76] Inventor: Dwight M. Prosser, 673 S. Lex-Springmill Rd., Mansfield, Ohio 44906

[21] Appl. No.: 878,738

[22] Filed: Feb. 17, 1978

Related U.S. Application Data

[62] Division of Ser. No. 624,757, Oct. 23, 1975, Pat. No. 4,078,336.

[51] Int. Cl.[2] ..... E05D 17/00

[52] U.S. Cl. ..... 16/197; 49/445; 16/210; 16/206

[58] Field of Search ..... 16/197, 198, 193, 194, 16/198, 202, 206, 210, 214, 211; 49/445, 446, 414, 429, 453

[56] References Cited

U.S. PATENT DOCUMENTS

| | | | |
|---|---|---|---|
| 3,012,292 | 12/1961 | Brengman | 16/197 X |
| 3,128,510 | 4/1964 | Fanello et al. | 16/197 X |
| 3,233,278 | 2/1966 | Lundgren | 16/197 |
| 3,293,686 | 12/1966 | Lundgren | 16/197 |

*Primary Examiner*—George H. Krizmanich
*Attorney, Agent, or Firm*—William P. Hickey

[57] ABSTRACT

A rattle free window having a sash balance that is provided with a sash hook that is connected to a slide by slot and pin means so arranged that the weight of the sash thereon cam; the slide laterally against the window jamb. The sash balance may also include a novel clip which both fixes one end of the balance spring to its housing and also attaches the housing to the window jamb. The window may also include a ramp clip which automatically catches the slide when the sash is raised so that further raising of the sash can lift the sash off of the novel sash hook and slide structure.

8 Claims, 20 Drawing Figures

WINDOW AND SASH BALANCE

This is a division of application Ser. No. 624,757, filed Oct. 23, 1975 now U.S. Pat. No. 4,078,336.

BACKGROUND OF THE INVENTION

Windows having sliding sashes comprise a frame having a top, bottom and side members, two of which have parallel grooves therein in which the opposite side edges of the sashes slide. In the case of vertically hung or slidable sashes, the grooves are in the side members of the frame, which side members are called jambs. The frames are mounted in building openings which are bounded by rough structural members to which the frames are fastened. In the case of wood frame buildings, for example, the building openings are bounded by 2×4's, and the frames are fastened thereto by nailing the jambs to the 2×4's. Most building openings are inaccurately made and the sides thereof are not exactly parallel. In addition, the side members, particularly when 2×4's, may have a bow therein, so that the jambs of the frames nailed thereto are pulled out of parallel. When the sash receiving grooves are not parallel, the sashes have sideplay when they are opened, with the result the they rattle when subjected to vibration. Vertically slidable sashes are made to stay in any opened position in which they are placed, by structures called sash balances. Sash balances in some instances are merely a pair of weights, each of which are connected to the sashes by a cord which extends from the weight over a pulley in the top of the jamb and then down to an anchor in the sash. In other instances, sash balances have comprised a spring inside a vertically extending housing that is fixed to the side of the jamb, and which has an extensible member that is fixed to the sash.

An object of the present invention is the provision of a new and improved vertically hung sash that is rattle free even when the jambs between which it is installed are considerably bowed or out of parallel.

Another object of the invention is the provision of a rattle free vertically hung sash of the above mentioned type in which the sash has sufficient clearance with respect to one of the jambs in which it is received so that it can be moved sideways a sufficient distance to bring the opposite edge of the sash out of its sash receiving groove to thereby permit the sash to be removed from the window frame, and in which the sash is normally and automatically held centered in a manner accomodating a large amount of nonparallelism of the jambs.

A further object of the invention is the provision of a new and improved structure of the above described type in which the centering, and the jamb clearance accomodating function is performed by structure that is part of the balance structure.

Further objects and advantages of the invention will become apparant to those skilled in the art to which the invention relates from the following description of several preferred embodiments that are described with reference to the accompanying drawings forming a part of the present disclosure.

DESCRIPTION OF THE PREFERRED EMBODIMENTS

Figure 1:
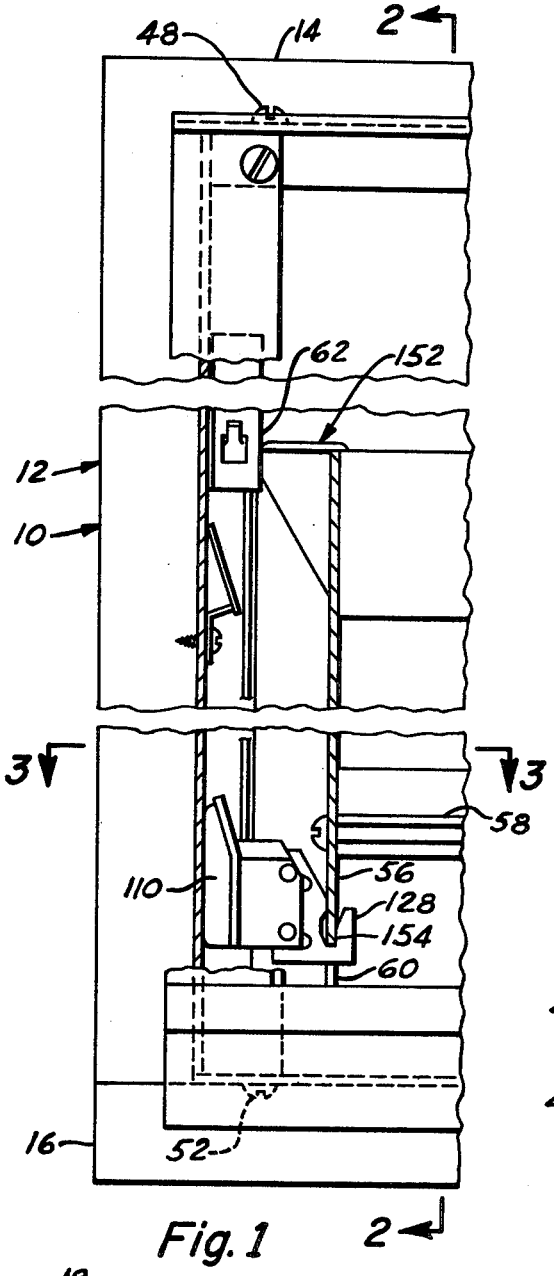
FIG. 1 is a fragmentary side elevational view of a vertically hung sash type window having a frame made of extruded aluminum sections, and showing a bottom sash which is slidably received in the jambs for vertical movement, and which embodies principles of the present invention—the view showing the side jamb sectioned through its sash receiving groove to better illustrate the sash balance structure.
Figure 2:
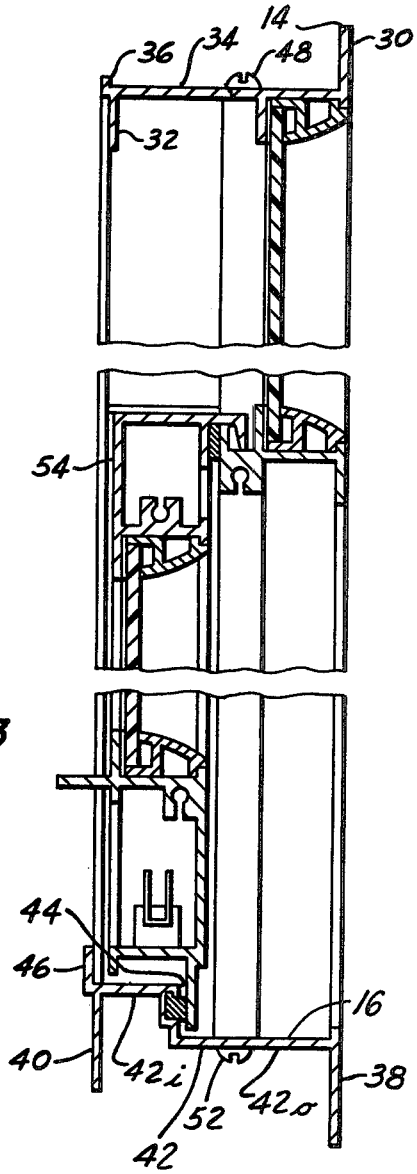
FIG. 2 is a somewhat schematic sectional view taken approximately on the line 2—2 of FIG. 1.
Figure 3:
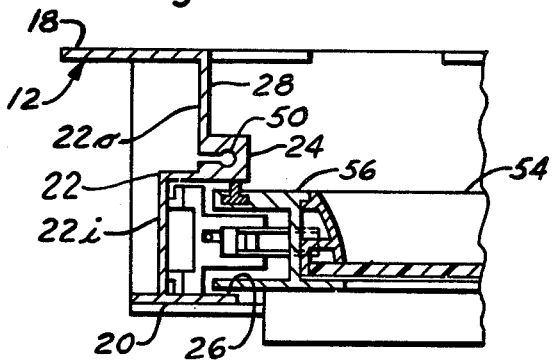
FIG. 3 is a fragmentary sectional view taken approximately on the line 3—3 of FIG. 1.

The window shown in FIGS. 1 through 3 of the drawings is of all aluminum construction and is of the single hung type i.e. single slidable sash type. The frame 10 comprises a pair of jambs 12 which are identical and which are made of the extruded aluminum shape shown in FIG. 3. The frame further comprises a header 14, of the extruded aluminum shape, best seen in FIG. 2, and a sill 16 of the extruded aluminum shape best seen in FIG. 2. The jamb section is of generally channel shape having an outer facia flange 18, an inner facia flange 20, and an offset web 22 that is divided into inner and outer sections **22*i* and 22*o*, respectively, by a jamb channel divider 24. The inner web portion 22*i* forms the bottom of the inner sash channel 26, and the outer web section 22*o* forms the bottom of the outer screen channel 28**.

The header section 14 is of generally Z-shape having: an outer facia flange 30, an inner facia flange 32, and a straight connection web 34. The section is also provided with a short upwardly extending inner lip 36, that is spaced inwardly of the face of the inner facia flange 32 by a distance corresponding to the thickness of the inner facia flange of the jamb.

The sill section is of generally channel shape and has: an outer facia flange 38, an inner facia flange 40, and a stepped web 42, the inner section of which is stepped vertically to provide a shoulder 44, the outer surface of which is overlapped by the sash. The sill section also includes a short upwardly extending inner lip 46 that is spaced inwardly of the inner facia flange 40 for the purpose of overlapping the inner facia flange of the jambs.

The upper ends of the jambs are cut at right angles to their length to provide a flat surface that abuts the bottom surface of the connecting web of the header. A saw cut is made across the inner web **22*i* of the jamb immediately behind the inner facia flange 20 to receive the inner facia flange 32 of the header 14. The header 14 is held down upon the jamb 12 by a pair of self-tapping screws 48 which are threaded into a longitudinally extending screw hole 50 that is generally centered in the jamb channel divider 24. The bottom end of each jamb section 12 is cut off to abut the upper surface of the web 42 of the sill section 16, with the inner facia flange 20 and inner web portion 22*i* of the jamb being notched out to receive the shoulder 44 of the sill 16. Each side of the sill is held to the jamb by a self-tapping screw 52 which is threaded into the lower end of the longitudinally extending hole 50** of the jamb.

The sash 54 shown in FIGS. 1 through 3 is also made from extruded aluminum sections the construction of which will not be given in detail, since an understanding thereof is not essential to an understanding of the present invention. The construction of the sash however can be made out from FIGS. 1 through 3 of the drawings. Suffice it to say that the stiles 56 of the sash extend downwardly of the bottom rail 58 of the sash, and that each stile 56 is notched out at the bottom as at 60 to receive a sash hook, as will later be explained. As best seen in FIG. 3 of the drawings, the stile 56 is of generally channel shape—the outstanding legs of which are spaced from the bottom of the inner sash channel 26 by a distance that is less than half of the depth of the channel 26. By this expedientcy the sash 54 can be slid laterally until it bottoms in the sash receiving channel of one jamb, whereupon the opposite edge of the sash 54 is free and clear of the inner facia flange 20, and the sash can be removed inwardly of the frame. FIG. 3 of the drawings shows the sash 54 generally centered in the frame 10.

Figure 4:
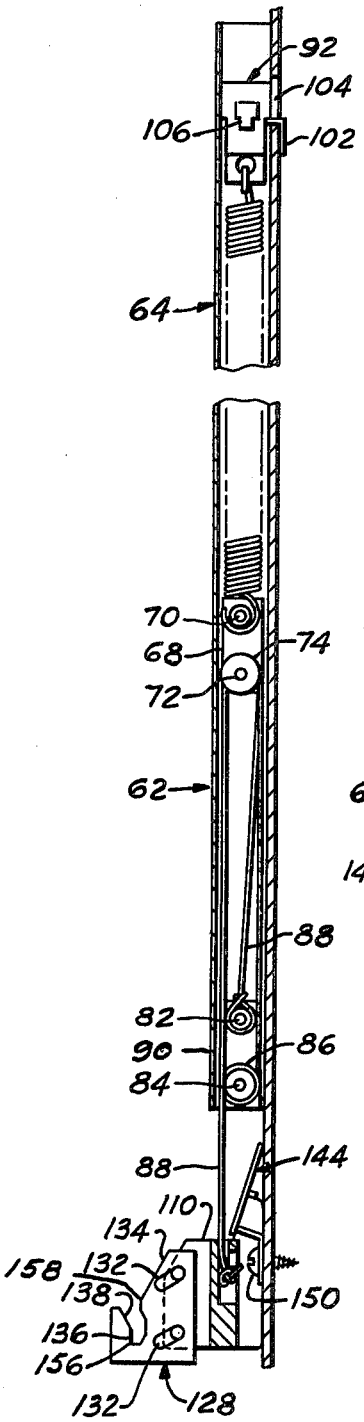
FIG. 4 is a side elevational view of the sash balance structure shown in FIGS. 1 and 3.

The sash 54 can be slid upwardly with its stiles 56 being guided in the inner sash channels 26 and while being centered therein by a sash balance structure 62 that embodies principles of the present invention, and that can best be seen in FIGS. 3 and 4 of the drawings. The sash balance structure 62 is of the block and tackle type, and has an elongated housing 64 of hat-shaped cross section. The sash balance structure 62 comprises an upper sheave 66 comprising opposite plates 68 that are connected together by top and bottom pins 70 and 72 that are riveted to the plates 68. The bottom pin 72 has a pulley 74 journaled thereon, and the top pin 70 receives the bottom hook of a coil spring 76, the top end of which is received in structure which will later be explained in detail. The upper sheave 66 is guided for vertical movement by the inner sidewalls of the housing 64. The sash balance 62 also includes a bottom stationary sheave 78 that comprises a pair of opposite plates 80 that are connected together by top and bottom pins 82 and 84, respectively. The bottom pin 84 journals a pulley 86 thereon, and the top pin 82 serves as a first anchor means for a cord 88 which extends upwardly around the pulley 74, which then loops around the pulley 86, which then loops around the pulley 74 again, and which then proceeds out of the bottom end of the housing 64 between the pulley 86 and the web 90 of the hat-shaped housing. The bottom end of the cord 88 provides an extensible member that is biased into the housing for purposes which will later be explained.

The upper end of the coil spring 76 is hooked into a novel spring anchor clip 92, which according to principles of the invention, also anchors the housing 64 on the jamb of the window frame. The spring anchor clip 92 is a stamping of a generally channel shape having a web 94, and opposite flanges 96. The bottom ends of the flanges 96 are bent inwardly against each other as at 98. The inwardly bent portions 98 have stamped openings 100 therein through which the upper end of the coil spring 76 extends, and by which the coil spring is anchored. The bottom end of the web 94 is bent outwardly and downwardly to provide a ear 102 that is adapted to project out of the back side of the housing member 64 for the purpose of hooking over the bottom edge of a hole 104 in the window jamb. The flanges 96 of the anchor are each provided with an outwardly and downwardly extending ear 106 for the purpose of hooking over the bottom edge of a pair of holes in the side walls of the elongated housing 64. For conveniency, the bottom edges of the holes 108 are best deformed inwardly by a distance corresponding to the thickness of the material of the sidewalls of the housing, so that the outer surfaces of the ears 106 can be slid downwardly of the housing 64 without springing the sidewalls of the housing apart. The upper hook of the coil spring 76 is first positioned in the hole 100 of the clip before the clip is slid downwardly into the housing 64. This is done with the spring slightly extended so that the spring in its retracted position will hold the ears 106 of the clip caught on the upper edges of the holes 108 of the housing 64. In the anchored position of the clip 92, the ear 102 projects out of the housing by a distance that is at least equal to the thickness of the jamb material on which the sash balance is intended to be used.

Figure 10:
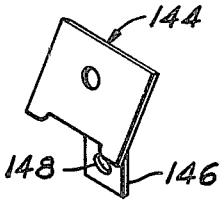
FIG. 10 is an isometric view of a ramp shown in FIGS. 4 and 5 for retaining the extensible member of the balance in a partially extended position.
Figure 11:
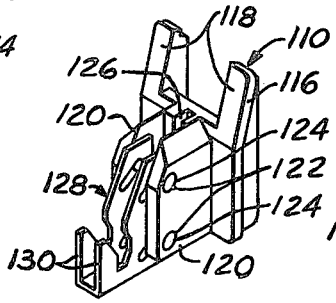
FIG. 11 is an isometric view of the combination sash hook and slide structure shown in FIGS. 4 and 5, and which is affixed to the extensible member of the sash balance.
Figure 12:
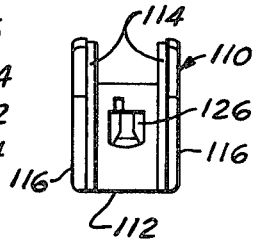
FIG. 12 is a rear view of the slide shown in FIG. 11.
Figure 13:
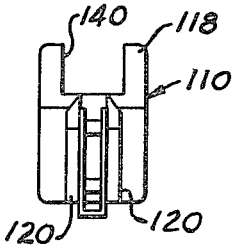
FIG. 13 is a rear view of the slide shown in FIGS. 4, 5, 11 and 12.
Figure 14:
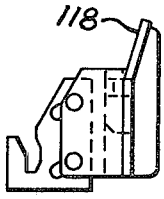
FIG. 14 is a side view of the combination sash hook and slide structure shown in FIG. 11.
Figure 15:
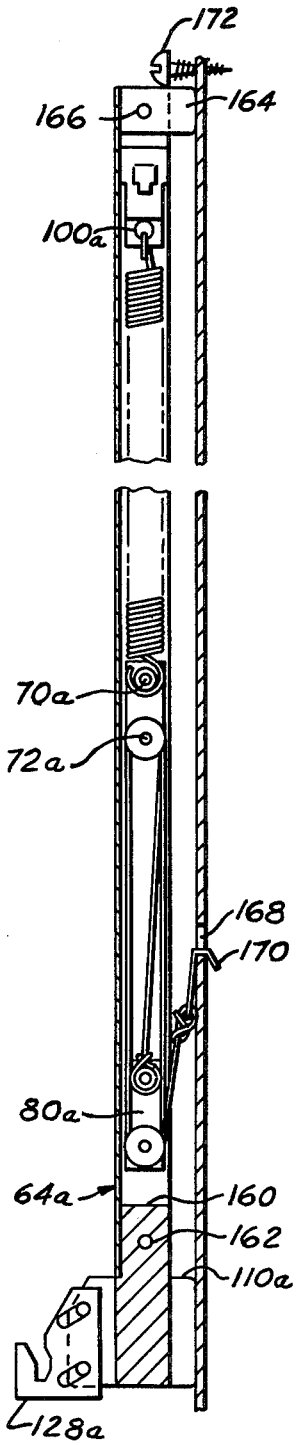
FIG. 15 is a side view similar to FIG. 4, but showing another embodiment of the invention.
Figure 16:
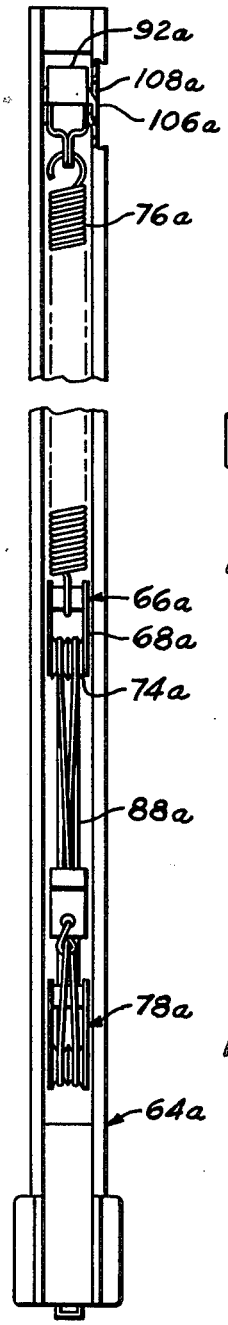
FIG. 16 is a rear view similar to FIG. 5, but showing the embodiment of FIG. 15.
Figure 17:
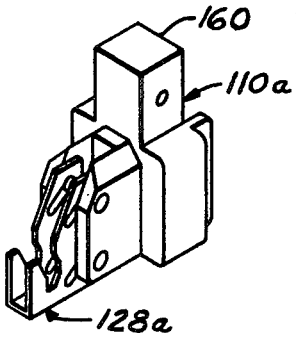
FIG. 17 is an isometric view of the sash hook and slide structure shown in FIGS. 15 and 16.
Figure 18:
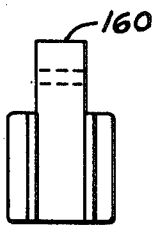
FIG. 18 is a rear view of the slide structure shown in FIG. 17.
Figure 19:
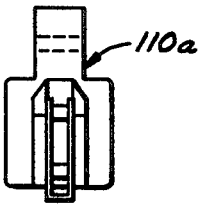
FIG. 19 is a front view of the slide structure shown in FIGS. 17 and 18.
Figure 20:
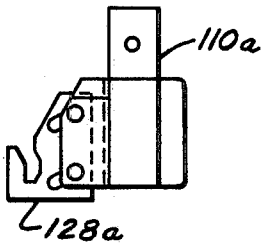
FIG. 20 is a side view of the sash hook and slide structure shown in FIGS. 15, 16 and 17.

The bottom end of the cord 88 is tied to a slide structure 110 that is adapted to slide along the bottom of the inner sash channel 26. The slide structure 110 is best made of a plastic, such as nylon. As best seen in FIGS. 10, 11 and 13 of the drawings, the slide structure 110 comprises a base 112 having a pair of spaced apart parallel ridges 114 which serve as runners for sliding along the bottom surface of the inner sash channel 26. The opposite side edges of the base 112 have longitudinally extending narrow ridges 116 for sliding along the side edges of the channel 26. The upper end of the base 112 is tapered at an acute angle of approximately 30 degrees with respect to the runners 114 to provide a tapered abutment surface 118 for purposes which will later be explained. The top surface of the base 112 is provided with a pair of parallel ears 120 each having a pair of vertically spaced openings 122 therein. The openings 122 of one ear are in line with those of the other ear and receive a pair of pins 124 which are pressed into the openings 122 and are firmly held therein. The upper end of the base 112 is provided with a stepped opening 126 therethrough for receiving the end of the extensible cord 88 with a knot in the cord being retained in the enlarged portion of the stepped opening 126 as seen in FIG. 4 to act as a second anchor means.

According to principles of the present invention, a laterally extensible sash hook 128 is affixed to, and is carried by the slide 110. The sash hook 128 shown in the drawings is a stamping that is bent into a narrow U-shape with its legs 130 being positioned vertically between the ears 120 of the slide 110. The legs 130 each contain a pair of slotted openings 132 with the openings of one leg being directly in line with the openings in the other leg, and with the pins 124 extending through the slotted openings 132. The slotted openings 132 are inclined at an angle of approximately 20 degrees with respect to the horizontal (perpendicular to runners 114 for reasons which will later be explained. The legs 130 have their upper-outer corners removed at an angle to provide camming surfaces 134 which are in line with each other and which form an angle of approximately 60 degrees with respect to the horizontal as previously defined. The outer lower ends of the camming surfaces 134 are intersected by a vertical sash receiving groove 136, the upper outer edge of which is beveled as at 138 to facilitate the entrance of the lower end of a projecting stile 56 of the sash, as best seen in FIG. 1.

The sash balance is assembled by wrapping the cord around the sheaves, by passing the extensible end of the cord through the opening 126, and by tieing a knot on the projecting end. The clip 92 is hooked on the upper end of the spring 76 and the unit is placed over the back end of the housing 64, with the clip 92 being positioned above the upper end of the housing. A downward pull on the assembly causes the clip 92 to pull down lengthwise into the housing, whereupon the ears 106 automatically slide into the holes 108 of the housing and become anchored on the lower edge of the openings 108. The bottom sheave 78 is likewise provided with a pair of ears, not shown, and the bottom end of the housing is provided with a pair of openings similar to the openings 108. The bottom sheave 78 is grasped and pulled downwardly to extend the spring 76 and bring the sheave 78 to a position beneath the lower end of the housing 64. Upon release of the bottom sheave 78 it slides upwardly into the bottom end of the housing until its pair of ears become anchored in the pair of holes in the flanges of the housing 64. The upper tapered abutment surface 118 of the slide 110 has a notch 140 therein that is slightly wider than the width of the housing 64; so that when force on the end of the extensible cord is released, the slide 110 will be pulled upwardly until the bottom end of the housing 64 is seated in the notch 140 and the slide 110 is in firm abutment with the bottom of the housing 64. By reason of the notch 140, the slide is retained laterally. Because the cord is positioned between the pulley and housing, the slide can not move outwardly; and because the projecting ends of the slide surface 118 engage the laterally extending legs 142 of the hat-shaped housing 64, the slide can not move backwardly off of the housing. During shipment, therefore, the slide 110 holds the balance structure in assembled relationship.

Figure 5:
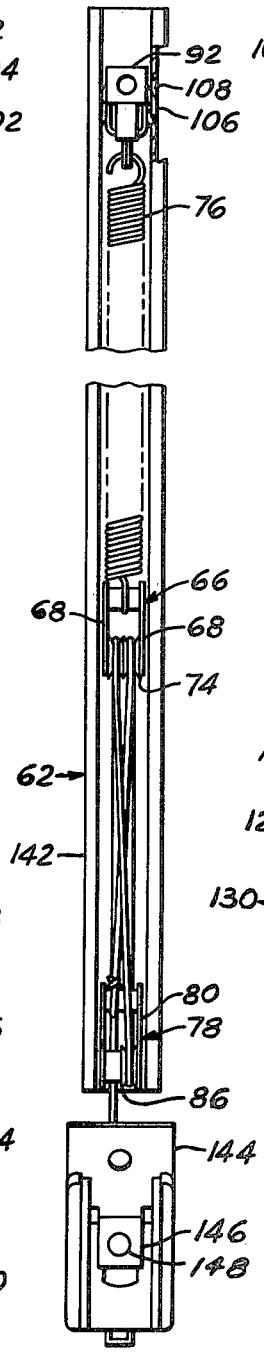
FIG. 5 is a rear view of the sash balance shown in FIG. 4.
Figure 6:
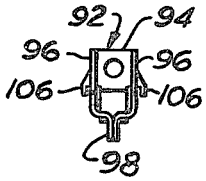
FIG. 6 is a rear elevational view of the combination spring and balance housing retaining clip shown in FIGS. 4 and 5, and which embodies principles of the present invention.
Figure 7:
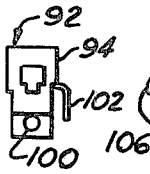
FIG. 7 is a side view of the clip shown in FIG. 6.
Figure 8:
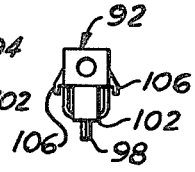
FIG. 8 is a front view of the clip shown in FIGS. 6 and 7.
Figure 9:
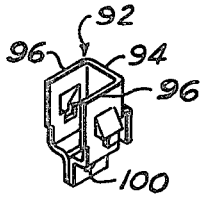
FIG. 9 is a isometric view of the clip shown in FIGS. 6 through 8.

FIGS. 4 and 5 of the drawings show the sash balance structure mounted on the jamb of a window. The mounting operation is performed by providing a hole 104 in both jambs of the window, if suitable holes are not already present; and by installing the ramp structure 144, best seen in FIGS. 4 and 10, on each jamb, a slight distance below the area which will later be occupied by the bottom end of the housing 64. The ramp 144, shown in the drawings, is a stamping having a generally square upper end—the width of which is just slightly less than the width of the sash receiving channel 26. The bottom end of the ramp 144 is provided with a narrow generally L-shaped, bent down leg 146 having a hole 148 in the foot of the leg. The leg 146 is bent at such an angle relative to the square upper end of the ramp, so that the square upper end forms an angle of approximately 30 degrees with the foot of the leg 146 which contains the hole 148. The ramp structure is positioned on the jamb of the window the location of the hole 148 is marked on the jamb, and the jamb is drilled for the reception of a self-tapping screw, as shown for example at 150 in FIG. 4 of the drawings. When installed on the jamb, the square upper end of the ramp 144 forms the same angle with the jamb as does the abutment 118 of the slide. The leg 146 of the ramp has a width which is less than the width of the notch 140 of the slide.

The installation of a sash in its frame is greatly simplified using the sash balance assemblies of the present invention. Before the sash is ready to be placed in the window it must be provided with plastic projections or guides 152 on its upper corners, if they have not already been provided by the sash manufacturer. This is done by simply drilling the sash stiles and fastening the plastic guides to the stiles with self-tapping screws. Assuming that the ramps 144 are in place, the sash balance structures are placed in position near the upper ends of the sash channels 26 with the ears 102 in the openings 104 of the jambs. Each assembly is thereafter pulled downwardly to hook the ears 102 on the bottom edges of the openings 104. Thereafter each slide 110 is pulled downwardly and is hooked beneath its ramp 144. The sash is positioned adjacent the header of the window with the plastic guides 152 above the top end of the balance housings 64. Thereafter one side edge of the sash is slid laterally into its sash receiving channel to bottom therein. When so bottomed the opposite side edge of the sash will be positioned inwardly of the opposing jamb, so that the sash can be pushed outwardly to bring both side edges of the sash in engagement with the jamb channel dividers. Upon releasing the weight of the sash, the tapered bottom edge of the plastic guides 152 will approximately center the sash with respect to the jambs. The sash is kept centered as the outer edges of the plastic guides slide down along the housing 64 of the sash balance structure. The slight weight of the sash hooks 128 causes the sash hooks to be in their most extended position relative to the slides 128, and the bottom lips 154 of the stiles 56 will move into engagement with the camming surfaces 134 of the sash hooks. Because the camming surfaces 134 are at a shallower angle relative to the lips 154 than are the side edges of the elongated openings 132 relative to the pins 124, the sash hooks will move inwardly and upwardly automatically over the ends of the lips 154 as the lips slide down the camming surfaces 134 and into the vertically sash receiving grooves 136. During this movement very little force is envolved, since the camming forces are only opposed by the weight of the sash hooks 128 themselves. When the lips 154 of the sash become seated in the bottom of the sash receiving grooves 136, further lateral movement is precluded. The hooks 128 can not cock on the lips 154 because of the outer lower abutment surfaces 156 and the inner upper abutment surfaces 158 of the sash receiving grooves 136.

The weight of the sash on the hooks 128 is transmitted thereafter through the pins 124 to the slides 110 to move the slides out of engagement with the ramps 144. An upward force on the slides 110 is provided at all times by the extensible cords 88 in an amount generally equal to the weight of the sash, so that the sash will stay in any vertical position in which the sash is placed. If a jamb of the window frame is not vertical, the force provided by the extensible cord 88 of that jamb balance structure will produce relative movement between its slide 110 and its sash hook 128 by reason of the inclined slotted openings 132 and pins 124. This relative movement pushes its slide outwardly relative to the sash to accomodate the lack of verticalism of the jamb. Because the weight of the sash acts in a true vertical plane, and because the extensible members of the sash balance structures work independently of each other, and of the sash, the opposing slides 110 move outwardly independently of each other to accomodate the irregularities of their respective jambs.

Once the slides come to rest, to support the sash in a particular position, the static friction between the slide 110 and the jamb on which it slides opposes any horizontal shifting of the pins 124 along the sides of the elongated openings 132, so that a considerable lateral force on the sash is necessary thereafter to produce any side movement of the sash. The static friction therefore of the slide on the jambs effectively prevents lateral sash movement and rattling of the window. When it is desired to remove the sash for cleaning, it is only necessary to raise the sash to its limit of travel adjacent the upper ends of the jambs, whereupon the slides 110 engage the bottom of the ramps 144. Thereafter the lips 154 of the sash, slide out of the sash receiving grooves 136 of the hooks 128, and a slight further movement thereafter brings the plastic guides 152 upwardly off of the upper ends of the housings 64. The sash can then be slide sideways into one of the sash receiving grooves of the jambs, and the opposite edge of the sash can then be pulled inwardly of the window frame.

The embodiment shown in FIGS. 15 through 20 is generally similar to the embodiment previously described, with the principal difference being that the extensible member of the sash balance structure is anchored to the jamb, and the housing of the sash balance structure is fixed to the sash. With this arrangement, the sash balance housing slides along the jamb of the window in which it is installed. Those portions of the embodiment shown in FIGS. 15 through 20 which correspond to similar portions of the embodiment shown in FIGS. 1 through 14 are designated by a like reference numeral characterized further in that a subscript "a" is affixed thereto. In the embodiment shown in FIGS. 15 through 20, no ramp 144 is used; and the lower slide structure 110*a*, instead of having an upper tapered abutment 118, is provided with an outwardly extending boss 160 having a snug fit in the bottom of the housing 64*a*. Appropriate holes are provided in the bottom of the housing 64*a* and the boss 160, and a rivet 162 is installed through the aligned openings, with the ends of the rivet being peened over to firmly retain the slide on the bottom end of the housing 64*a*. The upper end of the housing 64*a* is provided with a plastic cap or upper slide 164 that is fixed to the housing 64*a* by a rivet 166. The end of the cord 88*a* is passed through the opening of a hook structure or second anchor means 170 and is tied thereto.

The balance structure is installed on a jamb by merely hooking the hook 170 in an appropriate opening located in the jamb slightly below its midpoint and by pulling the housing 64*a* downwardly. A suitable stop 172 is positioned near the top of the jamb to limit upward movement of the housing 64*a* and when the cord 88*a* retracts, the housing moves upwardly into engagement with the stop. The sash guide 152 is then moved over the top of the housing 64*a*, and the sash is then lowered to bring the plastic guide 152 opposite the housing 64*a*. Further downward movement of the sash causes the lips 154*a* of the sash to slide downwardly into the sash hooks 128*a* in the same manner as previously explained for the embodiment shown in FIGS. 1 through 14. The operation of the embodiment shown in FIGS. 15 through 20 is generally the same as that described for the embodiment shown in FIGS. 1 through 14 excepting that the housing 64*a* moves in unison with the sash.

It will now be seen that the structure that has been provided fulfills the objects heretofore enumerated and that the desired results have been accomplished.

While the invention has been described in considerable detail, I do not wish to be limited to the particular embodiments shown and described; and it is my intention to cover hereby all novel adaptations, modifications, and arrangements thereof which come within the practice of those skilled in the art to which the invention relates, and which fall within the purview of the following claims.

I claim:

1. A window comprising: a frame having opposing jambs with vertical sash receiving grooves which face each other, a sash having channel shaped stiles with outwardly extending legs received in said opposing vertical grooves, a pair of elongated balance housings of generally uniform cross section with respective ones being positioned in respective ones of said opposing vertical grooves, an extensible member projecting outwardly of each housing, retraction spring means in each housing for retracting said extensible members, first anchor means on each of said extensible members, second anchor means on each of said balance housings, a pair of sash guides for spacing the upper opposite sides of said sash from said balance housings, a pair of sash hooks respective ones of which are hooked to the respective bottom corner of said sash, a pair of slides respective ones of which are positioned in respective vertical sash receiving grooves, one of said first and second anchor means being fastened to said slides and the other of said first and second anchor means being fixed to the jambs of said window, and inclined slot and pin means connecting said sash hooks to said slides with the slots thereof extending upwardly and laterally ourwardly toward said jambs, and whereby the sash is centered between jambs and is kept from rattling.

2. A balance system for sash of the type having channel chaped stiles with outwardly extending legs adapted to be received in a vertical groove in the jamb of a window frame, said system comprising: an elongated balance having a housing of a generally uniform U-shape cross section adapted to be positioned in the vertical groove of a jamb of a window frame, said housing having an extensible member projecting therefrom, a retraction spring in said housing having an extensible member, first anchor means connecting said extensible member to said housing, second anchor means for connecting said extensible member to said frame, a sash hook adapted to receive the bottom of a sash, a slide adapted to be positioned in and slide along a vertical groove in the jamb of a window frame, said second anchor means fastening said slide to said balance housing and said first anchor means being arranged for fastening to the jamb of a window, and inclined slot and pin means connecting said sash hook and slide in such manner that the weight of a sash on said sash hook forces said slide outwardly from said sash, and whereby the slide is biased into engagement with the jamb of a window in which it is installed to center the sash and keep it from rattling.

3. A sash balance having top and bottom ends comprising: an elongated housing of generally U-shape having a web and generally parallel legs, said legs having a pair of openings therethrough providing abutments facing the top end of said housing, a retraction spring in said housing, said spring having a hook at the top end thereof, a spring anchor clip having two sides adapted to engage the inside of the legs of said housing, said two sides having outwardly and downwardly extending ears which receive the abutments of said opening in said legs of said housing, at least one of said sides having an opening adjacent the bottom thereof which receives said hook of said retraction spring, a pulley retained between said legs of said housing adjacent the bottom end of said housing, an extensible member extending over said pulley with one end operatively connected to the bottom of said retraction spring and the other end proceeding upwardly and outwardly for connection to the jamb of a window frame, a slide fixed to said housing beneath said pulley, and means for supporting a sash on said slide, and whereby the weight of a sash and the reaction of said retraction spring draws the top and bottom of said sash balance outwardly to hold it in sliding engagement with a jamb.

4. The sash balance of claim 3 wherein: said last mentioned means comprises a hook having an abutment for retaining a downwardly facing lip on a sash to be retained, slot means on said hook extending upwardly and outwardly, and pin means carried by said slide and extending through said slot means, with at least part of said slot means being generally at or below the level of said abutment of said hook.

5. A sash balance having top and bottom ends comprising: an elongated housing of generally U-shape having a web and generally parallel legs, a retraction spring in said housing, attachment means securing the top of said retraction spring to said housing, a slide fixed to the bottom end of said housing, a pulley retained between said legs in the lower end of said housing upwardly of said slide, an extensible member extending around the bottom side of said pulley with one end operatively connected to the bottom of said retraction spring and the other end proceeding upwardly and outwardly for connection to the jamb of a window frame, and laterally extensible means for supporting a sash from said slide, and whereby said extensible member will maintain the top and bottom of said housing against a jamb of a window regardless of parallelism to prevent rattling therebetween while variations in clearance between a window and jamb is taken up between the lower end of said housing and window by said last mentioned means at a point below said pulley.

6. The sash balance of claim 5 wherein: said last mentioned means comprises a hook having an abutment for retaining a downwardly facing lip on a sash to be retained, slot means on said hook extending upwardly and outwardly, and pin means carried by said slide and extending through said slot means, with at least part of said slot means being generally at or below the level of said abutment of said hook.

7. The sash balance of claim 5 wherein said attachment means comprises a generally U-shaped sheet metal clip, said clip having legs for abutment with the inside leg surfaces of said housing, a pair of downwardly and outwardly facing ears on said legs of said clip adapted to engage upwardly facing abutments on said legs of said housing, the bottom ends of said clip legs being bent inwardly to provide portions which engage each other, and an opening through the engaging portions for receiving an end of said retraction spring.

8. An anchor clip for fastening a coil spring to a housing of generally U-shape cross section, said anchor clip comprising: a generally U-shaped sheet metal clip, said clip having legs for abutment with the inside leg surfaces of said housing, a pair of downwardly and outwardly facing ears on said legs of said clip adapted to engage upwardly facing abutments on said legs of said housing, the bottom ends of said clip legs being bent inwardly to provide portions which engage each other, and an opening through the engaging portions for receiving an end of said retraction spring.

* * * * *